United States Patent [19]

Turner

[11] 4,145,948

[45] Mar. 27, 1979

[54] GRAPHITE COMPOSITE NECK FOR STRINGED MUSICAL INSTRUMENTS

[75] Inventor: Warwick A. Turner, Santa Rosa, Calif.

[73] Assignee: Modulus Graphite Products, San Francisco, Calif.

[21] Appl. No.: 868,820

[22] Filed: Jan. 12, 1978

[51] Int. Cl.[2] ..... G10D 3/00

[52] U.S. Cl. ..... 84/293; 84/452 P

[58] Field of Search ..... 84/291, 293, 267, 452 R, 84/452 P

[56] References Cited

U.S. PATENT DOCUMENTS

| | | | |
|---|---|---|---|
| 2,597,154 | 5/1952 | Maccaferri | 84/293 X |
| 3,880,040 | 4/1975 | Kaman | 84/291 |
| 3,943,816 | 3/1976 | Goursau | 84/293 |

*Primary Examiner*—Lawrence R. Franklin
*Attorney, Agent, or Firm*—John N. Randolph

[57] ABSTRACT

A stringed musical instrument having a high stiffness dimensionally stable neck attached to a conventional instrument body made of hard wood. The neck is made of graphite fiber reinforced plastic material which produces a lighter, stiffer and more rigid structure than a conventional wooden neck. This high stiffness and the dimensional stability of the graphite composite, even under adverse temperature and humidity conditions, prevents warping and distortion of the instrument neck. The dimensional stability along with the high stiffness to density ratio and minimal sound damping characteristics of the graphite composite neck produce improved and stable acoustic tonal qualities from the instrument.

8 Claims, 5 Drawing Figures

GRAPHITE COMPOSITE NECK FOR STRINGED MUSICAL INSTRUMENTS

BACKGROUND OF THE INVENTION

This invention relates generally to necks for stringed musical instruments, and more specifically to a graphite fiber reinforced plastic molded construction for the neck of such instruments. This neck when combined with a conventional instrument body, because of its high stiffness and dimensional stability and because of the acoustic properties of the graphite composite laminate, results in an instrument with improved and stable tonal qualities.

The necks of such instruments are generally made of wood which are prone to warp, bend, or change dimensionally due to affects on the wood of changes in ambient temperature and moisture or humidity conditions of exposure. Since any dimensional changes such as warping, bending, shrinkage, or growth will adversely affect the musical sound qualities of the instrument by changing the tension of the strings or changing the distance between the strings and the frets, modifications have been made to try to overcome these deficiencies. Early prior art included adding one or more steel truss rods down the length of the neck to stiffen it. More recent prior art includes laminated neck constructions incorporating metal, plastic, or various wood layers by integrally laminating or combining them with conventional woods used in neck construction. Additional prior art incorporates an elaborate stiffening truss structure. Recent prior art includes instruments having necks constructed of aluminum. The aluminum necks do not bend or warp and are not affected dimensionally by humidity, but are not dimensionally stable since they are affected by changes in temperature due to the high thermal coefficient of expansion of aluminum. Aluminum is also prone to corrode under ambient humidity conditions and form an oxide surface layer which can blacken a player's hand. The aluminum can be protected with a coating, but a coating will degrade with time and can wear through. Instruments with aluminum necks are heavy and the neck has an unappealing feature of being cold to the touch.

All prior art necks of plastic, wood, or metal (including aluminum), or combinations thereof, result in instruments with excessive damping of the harmonic response characteristics from the strings. This adverse response and damping tends to limit the tonal qualities of the instrument. The graphite composite neck minimizes sound absorption and damping, and results in an instrument with sound qualities significantly superior to all prior art instruments.

The graphite composite neck overcomes many of the shortcomings of the prior art by producing an instrument which is: dimensionally stable under moisture and humidity conditions, dimensionally stable under varying temperature conditions, lightweight, and which has improved sound qualities because of the minimal sound damping characteristics of the neck. The hollow neck construction also allows for incorporating electrical wiring and other electrical or electronic devices within the neck structure.

SUMMARY

A primary object of the invention is to provide a neck for stringed musical instruments of either the acoustic or electric type such as guitars, bass guitars, banjos, mandolines, and similar instruments, which is constructed of graphite fiber reinforced plastic material having a high stiffness and low thermal coefficient of expansion and a high stiffness to density ratio, producing a dimensionally stable construction with unique sound characteristics.

Another object of the invention is to provide a neck which, when combined with a conventional instrument body, produces an instrument with improved tonal qualities and the ability to retain these tonal qualities over long periods of time and while exposed to varying environmental conditions.

Another object of the invention is to provide a stringed musical instrument with a graphite composite neck which produces richer and more brilliant tones, multiple harmonics, and which has the ability to sustain these tones for long intervals of time (up to several minutes).

A further object of the invention is to provide a stringed instrument with rich tones and sounds that are stable and are not affected by changes in ambient moisture or humidity conditions.

Still another object of this invention is to provide a stringed instrument with a graphite neck that has a very low coefficient of thermal expansion (close to zero) that is dimensionally stable and will produce rich tones and sounds that are also stable and are not affected by changes in temperature.

DESCRIPTION OF THE PREFERRED EMBODIMENT

Figure 4:
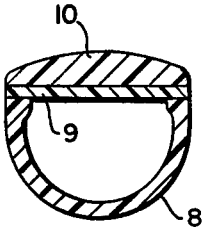
FIG. 4 is a cross sectional view taken generally on the line 4—4 of FIG. 2.
Figure 5:
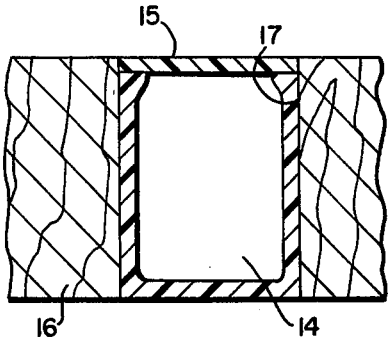
FIG. 5 is a fragmentary cross sectional view taken generally on the line 5—5 of FIG. 2.
Figure 3:
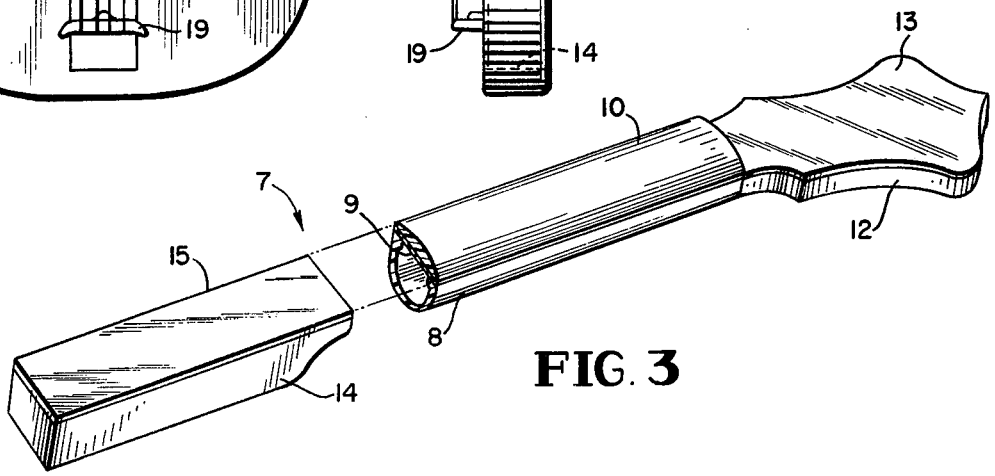
FIG. 3 is a fragmentary perspective view of the neck.

Referring more specifically to the drawing, the musical instrument neck comprising the invention is designated generally 7 and includes an integral molded graphite composite lower laminate structure 8 which is fabricated in one piece utilizing graphite fibers that are preimpregnated and embedded in polymeric resin matrix material, such as an epoxy. As seen in FIGS. 3, 4 and 5, the laminate structure 8 is of channel-shaped cross section, closed by an upper neck plate 9 which may be adhesively bonded to the structure 8 or molded integrally therewith. A finger board 10, having frets 11, is secured to the upper surface of the plate 9 as by being adhesively bonded thereto or molded integrally therewith.

The lower laminate structure 8 includes a head or pegbox 12 forming an extension of one end of the laminate structure 8 and which includes an upper pegbox plate 13 suitably secured thereto or molded integrally therewith.

A soundbox 14 forms an integral extension of the other end of the structure 8. The soundbox 14 is also of channel-shape cross section, as seen in FIG. 5, with its open top closed by a soundbox plate 15 which may be molded integrally therewith or adhesively bonded thereto.

Figure 1:
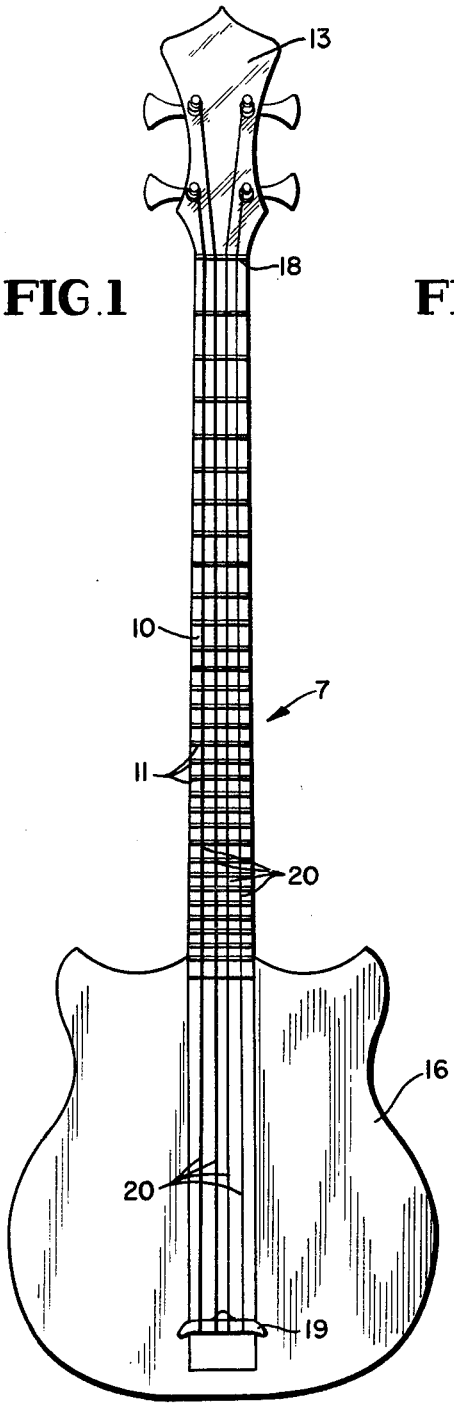
FIG. 1 is a front elevational view of the invention installed on a bass guitar.
Figure 2:
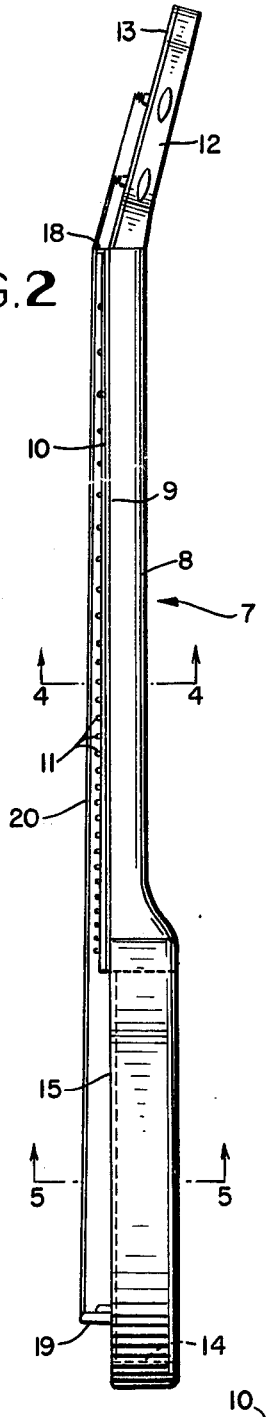
FIG. 2 is a side elevational view looking from right to left of FIG. 1.

The closed hollow construction of the neck 7 produces an extremely rigid structure having a high resonant frequency. Due to the orientation of the graphite fibers longitudinally along the length of the neck 7, a high stiffness in the direction of the instrument's strings is achieved. The neck 7 is adapted to be used as a part of either acoustic or electric type string musical instruments, including guitars, base guitars, banjos, mandolins, and the like, and is shown in FIGS. 1, 2 and 5 combined with a guitar body 16 formed of hard wood. As seen in FIG. 5, the soundbox 14 is disposed in a recess 17 of the body 16, in which it is secured in any suitable manner as by an adhesive bonding or by metallic fastenings, not shown.

Bridges 18 and 19 project from the upper surface of the neck 7, near the ends thereof, to support strings 20.

The manufacture of the neck components consisting of graphite composite material, is by molding under pressure at an elevated temperature. The cured components are machined by conventional techniques and adhesively bonded together producing a hollow neck beam structure of superior stiffness resulting in outstanding and stable acoustical tonal qualities for the instrument of which it is a part.

Various modifications and changes are comtemplated and may be resorted to, without departing from the function or scope of the invention.

I claim as my invention:

1. A neck for string musical instruments consisting of a molded graphite fiber reinforced plastic composite.

2. A musical instrument neck as in claim 1, wherein said fibers are oriented to achieve a maximum longitudinal stiffness.

3. A musical instrument neck as in claim 1, wherein said neck includes a pegbox section, a neck section and a soundbox section.

4. A musical instrument neck as in claim 1, wherein said neck includes a finger board of graphite fiber reinforced plastic composite.

5. A musical instrument neck as in claim 1, wherein said graphite fiber reinforced plastic composite is of closed hollow tubular construction.

6. A musical instrument neck as in claim 1, wherein said neck includes a channel-shaped bottom portion and a plate secured to and closing the open top of said bottom portion to provide a hollow neck beam structure.

7. A musical instrument neck as in claim 1, wherein said neck constitutes a continuous structural member extending substantially from end to end of the instrument.

8. A musical instrument neck as in claim 1, said neck constituting a part of an electric musical instrument.

* * * * *